US009138853B2

(12) United States Patent
Wang et al.

(10) Patent No.: US 9,138,853 B2
(45) Date of Patent: Sep. 22, 2015

(54) PORTABLE OPTICAL FIBER END FACE POLISHER

(71) Applicant: POLARLINK TECHNOLOGIES, LTD., Kaohsiung (TW)

(72) Inventors: Chun-Kuo Wang, Kaohsiung (TW); Shih-Tien Lin, Kaohsiung (TW); Jui-Yu Tsai, Kaohsiung (TW); Ching-Wen Hsiao, Kaohsiung (TW)

(73) Assignee: Polarlink Technologies, Ltd., Kaohsiung (TW)

( * ) Notice: Subject to any disclaimer, the term of this patent is extended or adjusted under 35 U.S.C. 154(b) by 239 days.

(21) Appl. No.: 13/956,543

(22) Filed: Aug. 1, 2013

(65) Prior Publication Data

US 2015/0038063 A1 Feb. 5, 2015

(51) Int. Cl.
*B24B 19/22* (2006.01)
*B24B 37/04* (2012.01)

(52) U.S. Cl.
CPC ..... *B24B 19/226* (2013.01); *B24B 37/04* (2013.01)

(58) Field of Classification Search
CPC ..... B24B 13/01; B24B 19/226; B24B 23/06
USPC ..... 451/355, 42, 344, 296; 385/134
See application file for complete search history.

(56) References Cited

U.S. PATENT DOCUMENTS

| | | | | |
|---|---|---|---|---|
| 2001/0033728 | A1* | 10/2001 | Miyake et al. | 385/134 |
| 2006/0191091 | A1* | 8/2006 | Kida | 15/210.1 |
| 2007/0259608 | A1* | 11/2007 | Bechtold et al. | 451/310 |
| 2011/0072600 | A1* | 3/2011 | Nakane et al. | 15/97.1 |
| 2011/0154599 | A1* | 6/2011 | Nakane et al. | 15/210.1 |
| 2012/0017384 | A1* | 1/2012 | Fujiwara | 15/97.1 |

* cited by examiner

*Primary Examiner* — Monica Carter
*Assistant Examiner* — Marcel Dion
(74) *Attorney, Agent, or Firm* — Rosenberg, Klein & Lee

(57) ABSTRACT

The present invention provides a portable optical fiber end face polisher that has a probe, a shuttle, a cover and a resilient actuator. The probe has a driving shaft holding a pin having two through holes. The shuttle holds the driving shaft, a supplying reel and a spooling reel. The cover guides the driving shaft to rotate axially and draws a cleaning medium from the supplying reel to pass through the through holes across a probing face of the pin to the spooling reel. The resilient actuator is mounted between a stopping base of the cover and the shuttle to recover the relative positions of the shuttle and the cover.

14 Claims, 8 Drawing Sheets

PORTABLE OPTICAL FIBER END FACE POLISHER

BACKGROUND OF THE INVENTION

1. Field of the Invention

The present invention relates to a portable polisher, especially to an optical fiber end face polisher with a continuous polishing medium.

2. Description of the Prior Art

A conventional polisher is used to clean and polish end faces of optical fibers, specifically those of the optical fibers to be connected to each other, in order to prevent transmission loss and to achieve industrially required cleanness for expectable performance of the connected optical fibers.

The conventional polisher has a probing point through which a polishing string is guided from a supplying reel through a point of a rod for polishing an end face of an optical fiber and then led backward to a spooling reel. The rod is operably connected to a retractable assembly in which the reels are installed. When the point of the rod presses against the end face of the optical fiber, the rod pushes the assembly backward so as to rotate the spooling reel by a linear driving structure engaging a coaxial gear attached to the spooling reel. As the polishing string from the supplying reel runs through the end face of the optical fiber, impurities which may have attached to the end face are carried away with the polishing string to the spooling reel and thus the end face of the optical fiber is polished.

The aforementioned linear driving structure of the conventional polisher is a sequence of teeth formed linearly on an inner surface of the assembly so as to radially engage teeth of the coaxial gear. The linear driving structure and the gear, however, may easily disengage from each other when the conventional polisher is subjected to an accidental shock along the axial direction, which immediately results in a failed conventional polisher.

Considering the environments and conditions in which a portable optical fiber end face polisher is employed, it is foreseeable that a conventional polisher would often encounter unintended and accidental shocks.

The assembly of the linear driving structure and the gear is covered inside the assembly of the conventional polisher, which makes it very difficult for a user to visually distinguish a failed polisher from a functioning one, whereby the user may not be aware of the non-functioning of the conventional polisher until the polisher is to be used in a place where no replacement polisher is available.

Furthermore, the spooling reel has two opposite ends and two toothed-wheels respectively attached to the ends, whereby the toothed-wheels are of different shapes for respectively engaging a check pawl of a case receiving the assembly and a detent means defined on a bottom surface of the gear. The supplying reel also employs similar structure that has two toothed-wheels. The structures of the reels lead to confusion and ineffectiveness since during the assembling process, a reel may be reversely mounted to the conventional polisher for which neither of the toothed-wheel function as designed.

To overcome the shortcomings, the present invention provides a portable optical fiber end face polisher to mitigate or obviate the aforementioned problems.

SUMMARY OF THE INVENTION

The main objective of the invention is to provide a portable optical fiber end face polisher.

The portable optical fiber end face polisher in accordance with the present invention has a probe, a shuttle, a cover and a resilient actuator. The probe has a driving shaft holding a pin having two through holes. The shuttle holds the driving shaft, a supplying reel and a spooling reel. The cover guiding the driving shaft to rotate axially and draw a cleaning medium from the supplying reel to pass through the through holes across a probing face of the pin to the spooling reel. The resilient actuator is mounted between a stopping base of the cover and the shuttle to recover the relative positions of the shuttle and the cover.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
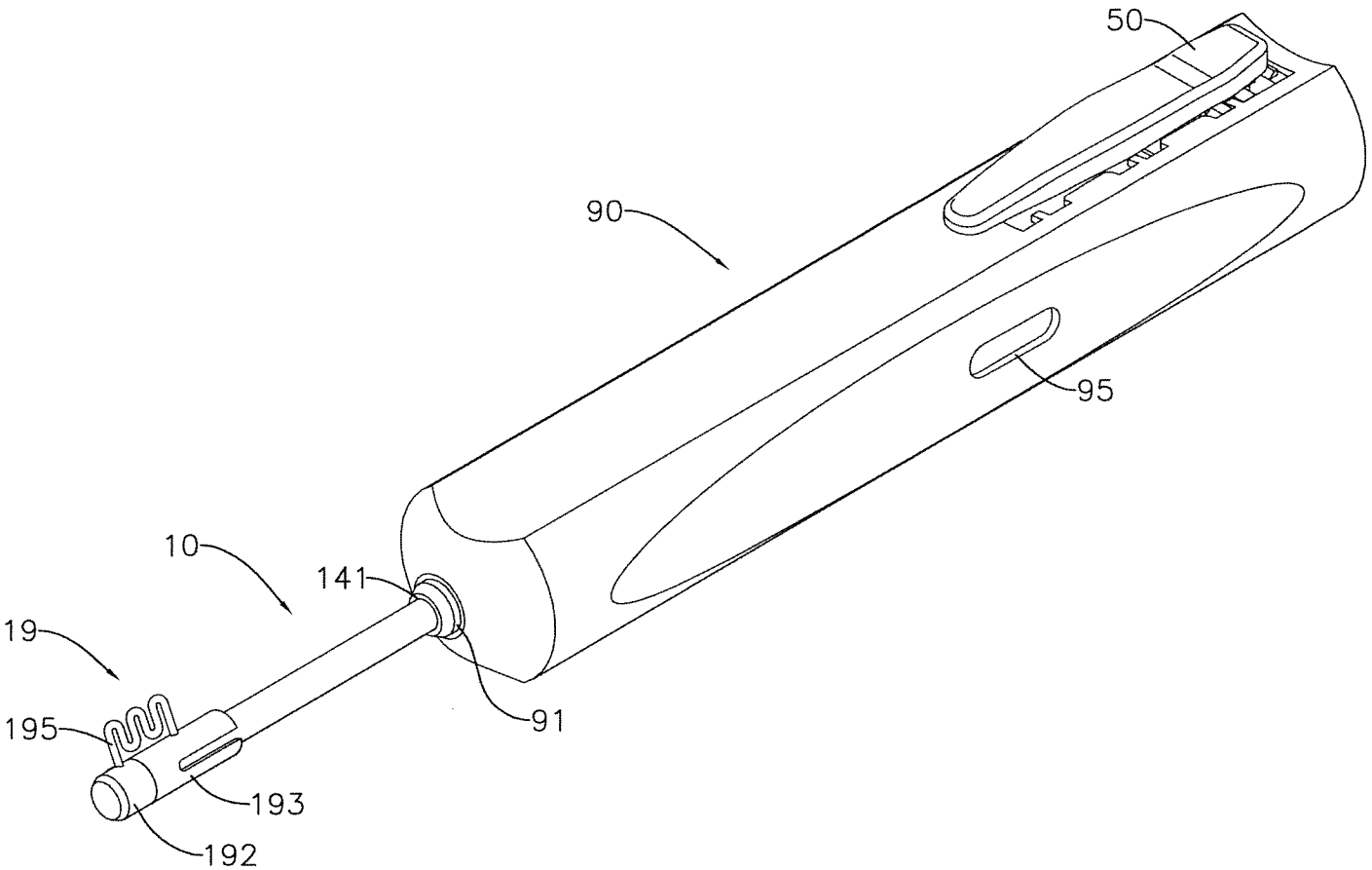
FIG. 1 is a perspective view of a portable optical fiber end face polisher in accordance with the present invention.
Figure 2:
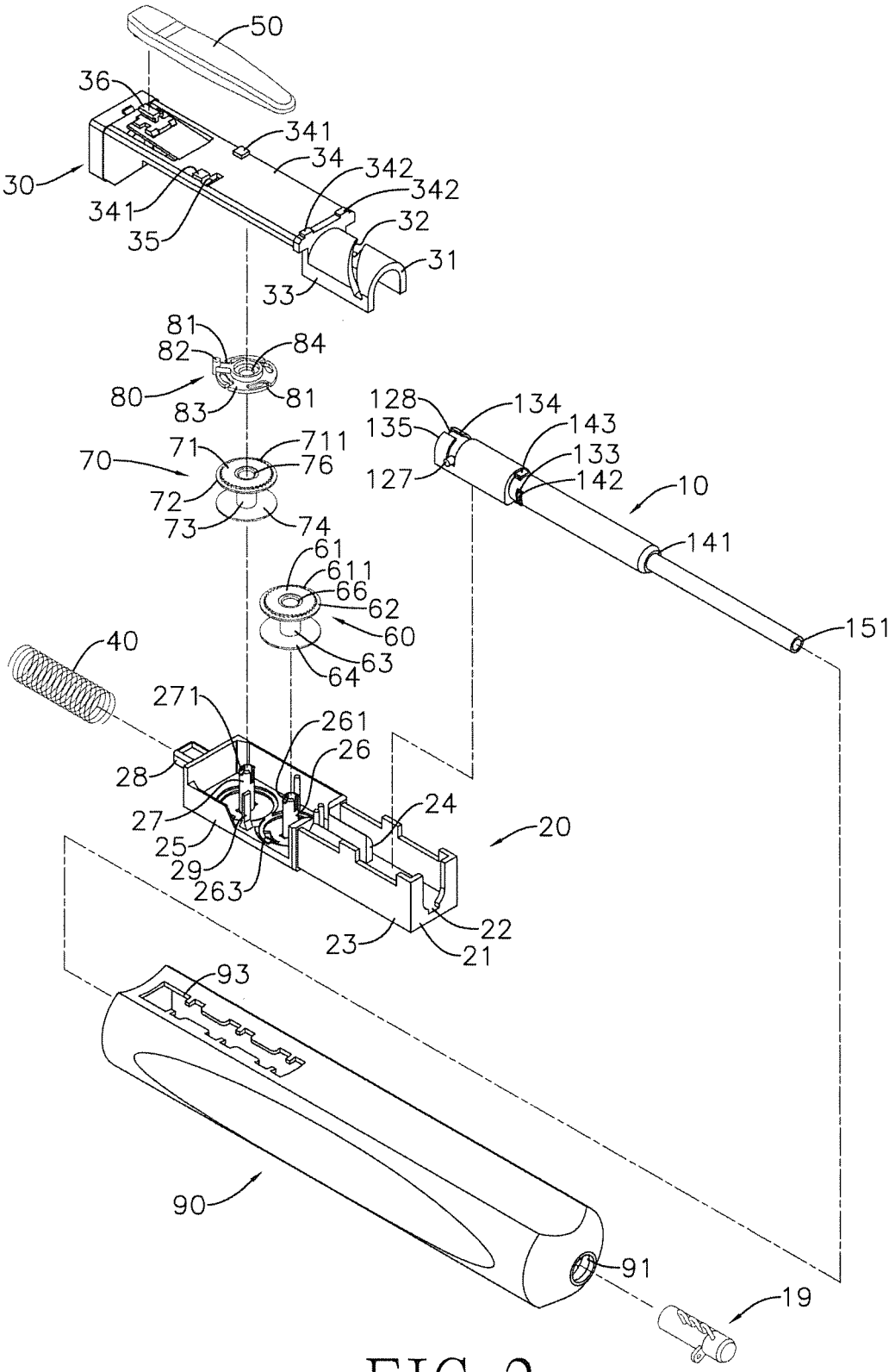
FIG. 2 is an exploded perspective view of the portable optical fiber end face polisher in FIG. 1.
Figure 3:
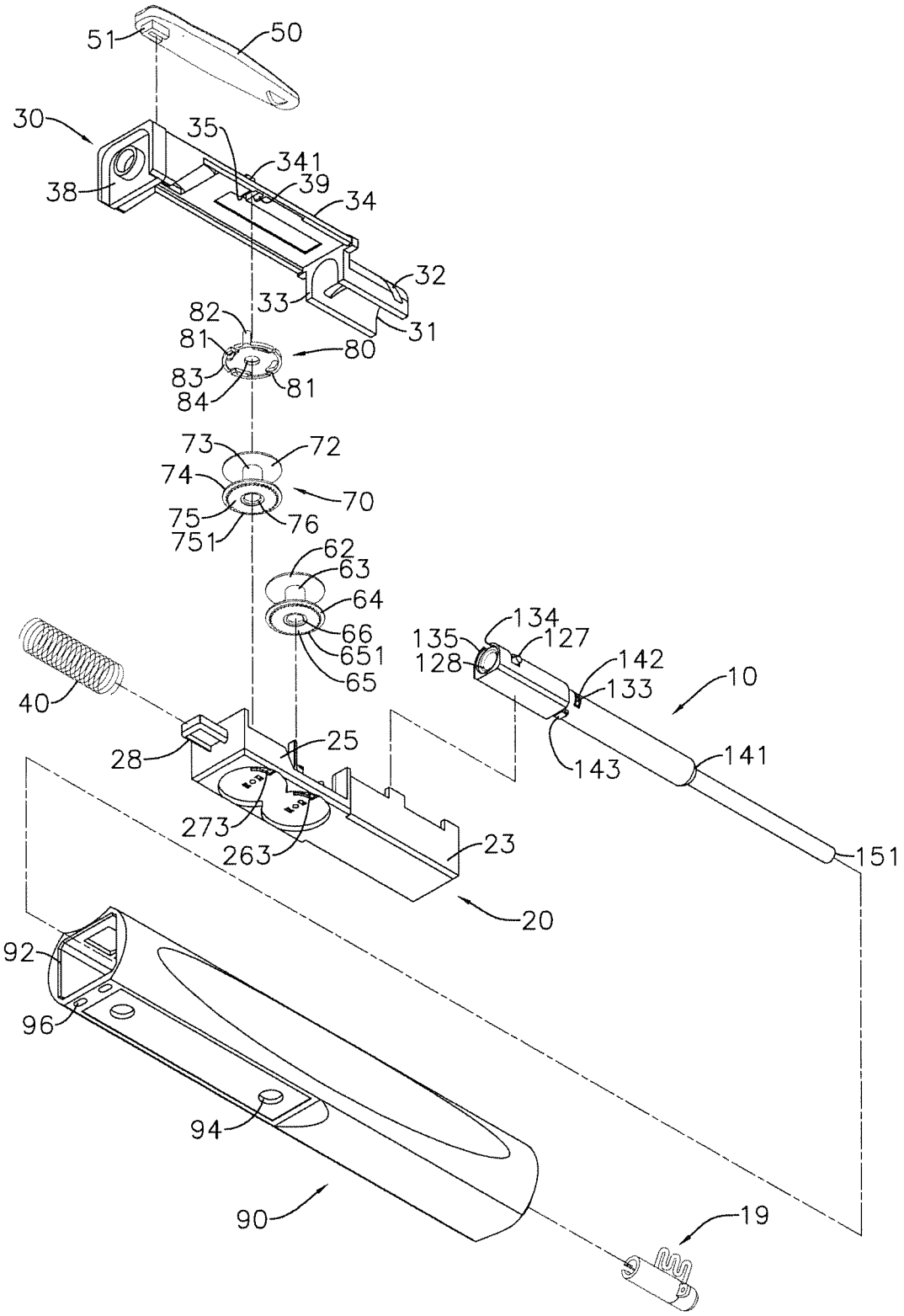
FIG. 3 is another exploded perspective view of the portable optical fiber end face polisher in FIG. 1.

With reference to FIGS. 1, 2 and 3, an embodiment of the portable optical fiber end face polisher in accordance with the present invention comprises a probe 10, a shuttle 20, a cover 30, a resilient actuator 40 and an optional casing 90.

Figure 4:
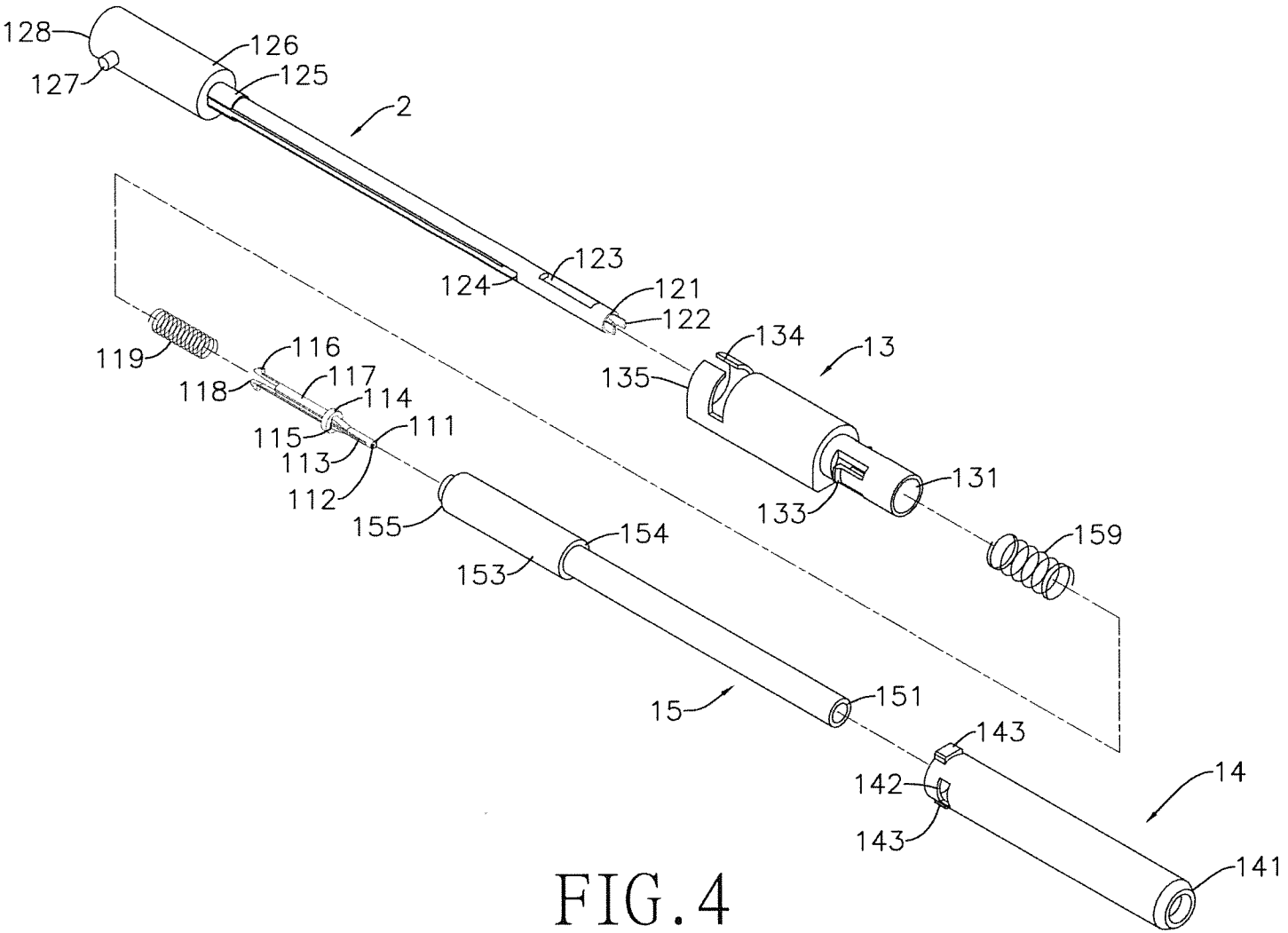
FIG. 4 is an exploded perspective view of the probe of the portable optical fiber end face polisher in FIG. 1.

With further reference to FIG. 4, the probe 10 comprises a driving shaft 12 and a pin 11. As demonstrated in the current embodiment, the probe 10 may further comprise a base tube 13, a securing sleeve 14 and a cushion column 15.

Figure 5:
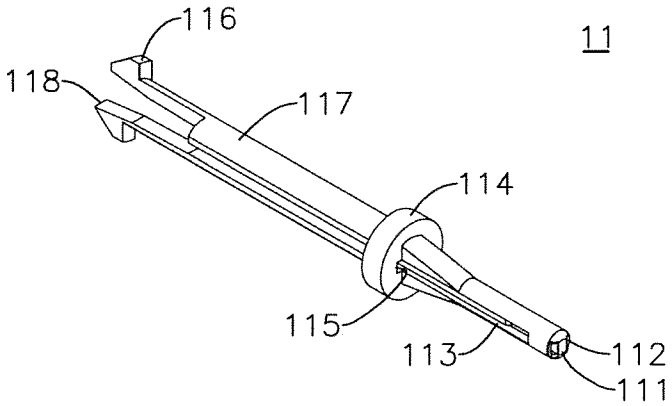
FIG. 5 is a perspective view of a pin of the portable optical fiber end face polisher in FIG. 1.
Figure 6:
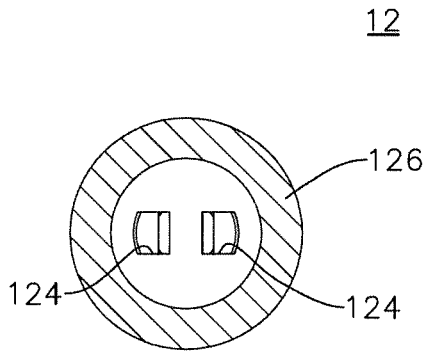
FIG. 6 is an end view in partial section of a driving shaft of the portable optical fiber end face polisher in FIG. 1.
Figure 7:
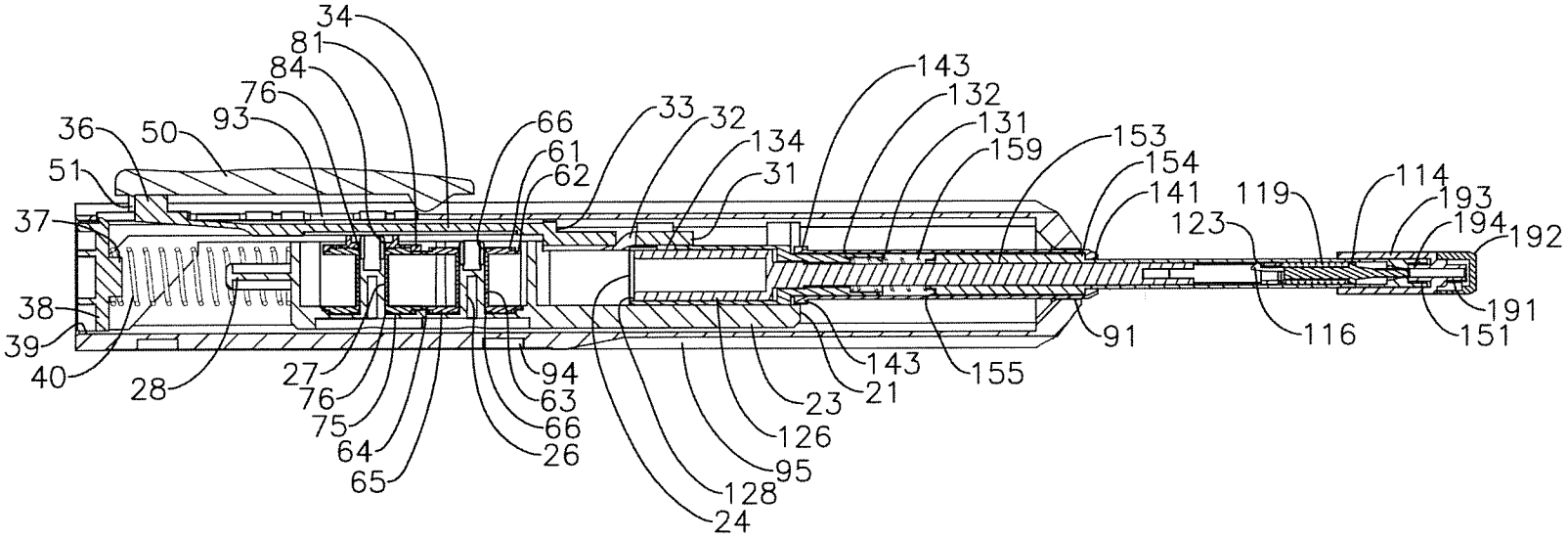
FIG. 7 is a sectional side view of the probe of the portable optical fiber end face polisher in FIG. 1.

With further reference to FIGS. 5, 6 and 7, the driving shaft 12 comprises a first end 121, a second end 128 opposite to the first end 121 and a guiding protrusion 127. In the current embodiment, the driving shaft 12 further comprises a diametrically enlarged portion 126 at the second end of the driving shaft 12.

The guiding protrusion 127 radially protrudes from the driving shaft 12. As described in the current embodiment, the guiding protrusion 127 protrudes from a side surface of the diametrically enlarged portion 126. The driving shaft 12 further comprises a pair of brackets 125 to connect a body of the driving shaft 12 and the enlarged portion 126. The driving shaft 12 comprises grooves 124 for a cleaning medium to pass through. A pair of supporting brackets 122 protrude from the first end 121 of the driving shaft 12 and a pair of retaining holes 123 are formed beside the first end 121 of the driving shaft 12 so as to better hold the pin 11.

Figure 8:
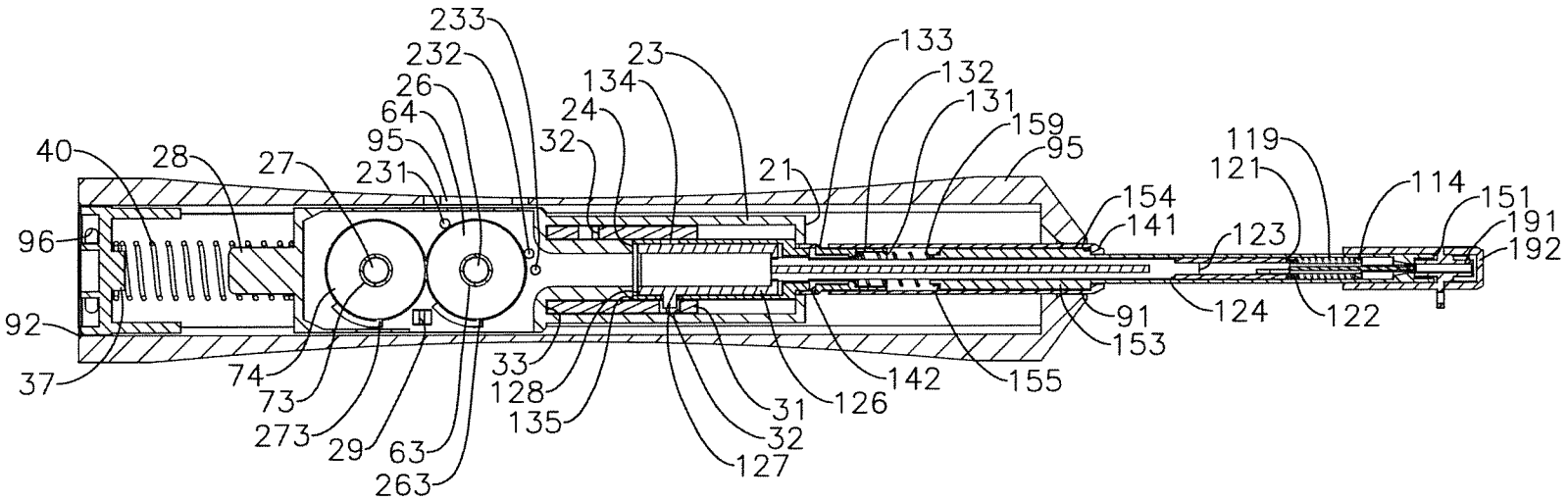
FIG. 8 is a sectional top view of the probe of the portable optical fiber end face polisher in FIG. 1.

The pin 11 is mounted to the driving shaft 12 and comprises a point portion 111 and two through holes 112. The point portion 111 protrudes from the first end 121 of the driving shaft 12 and comprises a probing face. The two through holes 112 are defined through the point portion 111. Each of the through holes 112 forms an opening on the probing face of the point portion 111 so that the cleaning medium passes across the probing face from one through hole 112 to the other through hole 112 for cleaning an end face of an optical fiber against which the probing face of the point portion 111 of the pin 11 is pushed. With further reference to FIG. 8, in the current embodiment, the pin 11 further comprises a stem 117, an annular disc 114, and a pair of end clips 116. The disc 114 is formed around the stem 117 and the end clips 116 are formed at an end of the pin 11 opposite to the probing face of the point portion 111. A slit 118 is recessed into the stem 117 between the end clips 116 so that the portions of the stem 117 immediately connected to the end clips 116, which are separated by the slit 118, are flexible for fastening the end clips 116 to the retaining holes 123 of the driving shaft 12. Side grooves 113 are formed on opposite sides of the stem 117. A pair of recesses 115 are defined through the annular disc 114 such that the side grooves 113 communicate with the through holes 112 to allow the cleaning medium to pass therethrough.

In the current embodiment, the cushion column 15 receives the pin 11 and comprises a first end 151, a first end opening 152, a resilient pin-cushion 119 and a columnar portion 153. The first end 151 comprises a protruding circumferential portion that forms a receiving sleeve for an optical fiber end held within a female optical fiber adapter. The structure of the first end 151 of the cushion column 15 is suitable for stably accessing the optical fiber end in the female optical fiber adapter during the polishing process. The resilient pin-cushion 119 is preferably a spring installed around the pin 11 and mounted in the cushion column 15. An end of the pin-cushion 119 is connected to the annular disc 114 and an opposite end of the pin-cushion 119 is connected to the supporting brackets 122, so as to selectively allow the probing portion 111 of the pin 11 to protrude out from the first end opening 152, so as to expose the probing face of the pin 11. The columnar portion 153 comprises a first end 154 and a second end 155. The first end opening 152 of the cushion column 15 may be sealed with a cap 19 covering the first end 151. The cap 19 comprises a tubular portion 193 to receive the first end of the cushion column 15. A plug 194 is formed within the tubular portion 193. The plug 194 selectively received within the protruding circumferential portion of the first end 151 of the cushion column 15. The cap 19 may further comprise a tip 191 and a tip cover 192 for better protection. Preferably, a through hole coaxial to the first end opening 152 is formed within the plug 194 and the tip 191 such that the pin 11 may protrude through the through hole from the tip 191 to access an optical fiber end face to be polished. More preferably, the tip cover 192 and the tubular portion 193 are connected with a curl cord. When the tip cap 192 is removed and put away from the tip 191, the curl cord holds the tip cap 192 to keep the tip cap 192 from being unintentionally lost.

A resilient cushion 159 is mounted to the second end 155 of the cushion column 15 for better cushioning effect that prevents rush force to an end face of an optical fiber.

The base tube 13 comprises an enlarged cylinder 135, a securing slot 134, a cushion seat 132 and a receiving cylinder 131. The enlarged cylinder 135 is mounted around the diametrically enlarged portion 126 of the driving shaft 12 and the securing slot 134 is formed through a sidewall of the enlarged cylinder 135 and receives the guiding protrusion 127 of the driving shaft 12. Preferably, the securing slot 134 is branched and opens at a rear end of the enlarged cylinder 135 so as to easily slide the guiding protrusion 127 from an opening branch into the securing slot 134 when assembling the polisher in accordance with the present invention. More preferably, the branch that leads to the rear end of the enlarged cylinder 135 is positioned at a central portion of the securing slot 134, so that the securing slot 134 forms a T-shaped structure, which allows dangling portions formed between the securing slot 134 and the rear end of the enlarged cylinder 135 are short and robust.

The cushion seat 132 is connected to an end of the resilient cushion 159 so that the resilient cushion 159 pushes the cushion column 15 away from the cushion seat 132. The receiving cylinder 131 receives the resilient cushion 159 and selectively receives the cushion column 15 such that the cushion column 15 shuttles into the receiving cylinder 131 by a pushing force from the pin 11 and out from the receiving cylinder 131 when being pushed by the resilient cushion 159.

The securing sleeve 14 secures the cushion column 15 to the base tube 13. As demonstrated in the current embodiment, the securing sleeve 14 holds the cushion column 15 and allows the cushion column 15 to protrude out from a first end opening 141. The securing sleeve 14 further comprises a pair of fastening holes 142 that are connected to a pair of fastening clips 133 formed on a side surface of the receiving cylinder 131 to secure the base tube 13.

The shuttle 20 is mounted to the second end 128 of the driving shaft 12 and comprises a supplying reel 60, a spooling reel 70 and a driving disc 80. As demonstrated in the current embodiment, the shuttle 20 may further comprise a fore cart 23, a rear cart 25 and an optional elastic piece 29.

The supplying reel 60 and the spooling reel 70 are rotatably mounted to the shuttle in parallel. As demonstrated in the current embodiment, the supplying reel 60 and the spooling reel 70 are pivotally held in the shuttle 20 and are structurally identical, and each of the reels 60, 70 has a symmetric structure that comprises an axle 63, 73, two holding plates 62, 64, 72, 74 and two toothed-wheels 61, 65, 71, 75. The axle 73 of the spooling reel 70 comprises a side surface and two ends. Preferably, a chamfer 76 is formed at an inner rim of each of the ends of the axle 73. The two holding plates 72, 74 radially extend respectively from the axle 73, and each of the two holding plates 72, 74 comprises an outer surface and an inner surface such that the inner surfaces of the two holding plates 72, 74 are attached respectively to the two ends of the axle 73. The two toothed-wheels 71, 75 are respectively coaxial to the axles 73 of the spooling reel 70 and respectively attached to the outer surfaces of the holding plates 72, 74. Each of the two toothed-wheels 71, 75 comprises a series of circumferentially formed unidirectional teeth 711, 751, wherein the two toothed-wheels 71, 75 are of identical shape, teeth number and teeth orientation. The supplying reel 60 comprises an identical structure as the foregoing structure of the spooling reel 70 with component counterparts, including the axle 63, two holding plates 62, 64 and two toothed-wheels 61, 65 having a series of circumferentially formed unidirectional teeth 611, 651, which are assembled same as the spooling reel 70, as well as optional chamfers 66.

The driving disc 80 engages the spooling reel 70 to drive the rotation of the same and comprises a detent face, a driving face and a driving protrusion 82. The driving face of the driving disc 80 is a surface opposite to the detent face. The driving protrusion 82 eccentrically protrudes from the driving face of the driving disc 80.

The detent face of the driving disc 80 engages the toothed-wheel 71 of the spooling reel 70, wherein the toothed-wheel 71 engaged with the detent face of the driving disc 80 is the toothed-wheel 71 that faces outward from the shuttle 20. As demonstrated in the current embodiment, the driving disc 80 comprises an embracing ring 83 mounted to the toothed-wheel 71 and the holding plate 72. On the embracing ring 83 at two opposite positions respectively forms a ratchet pawl 81 that engages the teeth 711 of the toothed-wheel 71 to permit and to drive unidirectional rotation of the spooling reel 70. Preferably, four ratchet pawls 81 are formed to firmly engage the teeth 711 of the toothed-wheel 71. In the current embodiment, the driving disc 80 further comprises a central hole 84 coaxial with the axle 73 of the spooling reel 70.

The fore cart 23 of the shuttle 20 receives the diametrically enlarged portion 126 of the driving shaft 12 and the base tube 13. Furthermore, as demonstrated in the current embodiment, the securing sleeve 14 is mounted in a fore slot 22 formed on a fore end of the fore cart 23 such that the fore slot 22 is of a shape matching a positioning block 143 of the securing sleeve 14. In the current embodiment, a pair of abutting blocks 24 is formed in the fore cart 23 to abut against the driving shaft 12 and the base tube 13 so as to receive a driving force delivered through the driving shaft 12.

The rear cart 25 of the shuttle 20 is tandemly attached to the fore cart 23 and pivotally receives the supplying reel 60, the spooling reel 70 and the driving disc 80. The rear cart 25 comprises a bottom, a first check pawl 263, a second check pawl 273 and optional guiding posts 231, 232, 233. The first check pawl 263 ratchets one toothed-wheel 65 of the two toothed-wheels 61, 65 of the supplying reel 60. The second check pawl 273 ratchets one toothed-wheel 75 of the two toothed-wheels 71, 75 of the spooling reel 70. The foregoing single-check-pawl structure allows light and nimble actuation. It is also feasible that the rear cart 35 comprises a multiplicity of the first check pawl 263, a multiplicity of the second check pawl 273, or both to firmly ratchet the toothed-wheels 65, 75.

The optional guiding posts 231, 232, 233 are defined within the rear cart 25 to guide a used cleaning medium to the spooling reel 70 without contaminating a fresh cleaning medium from the supplying reel 60. Preferably, the rear cart 25 comprises three guiding posts 231, 232, 233 that two guiding posts 231, 232 are defined beside the supplying reel 60 and the other guiding post 233 is defined between the fore cart 23 and the rear cart 25 to split the used cleaning medium from the fresh cleaning medium, so as to limit the used cleaning medium within a channel formed between an inner side wall of the rear cart 25 and the guiding posts 231, 232, 233, which prevents the used cleaning medium from contacting the supplying reel 60 or the fresh cleaning medium.

A first shaft 26 and a second shaft 27 are formed in the rear cart 25. The first shaft 26 points toward the cover 30, pivotally holds the supplying reel 60 through the axle 63 of the supply reel 60 and comprises an distal end and at least one clip 261 formed at the distal end to secure the supplying reel 60 to the first shaft 26. The chamfer 66 formed at the end of the axle 63 of the supplying reel 60 allows the supplying reel 60 to be free from friction against the clip 261 when rotating.

The second shaft 27, being paralleled with the first shaft 26, also points toward the cover 30 and pivotally holds the spooling reel 70 through the axle 73 of the spooling reel 70 and comprises a distal end and at least one clip 271 formed at the distal end for securing the spooling reel 70 to the second shaft 27. The chamfer 76 formed at the end of the axle 73 of the spooling reel 70 allows the spooling reel 70 to be free from friction against the clip 271 when rotating.

The elastic piece 29 extends from the bottom of the rear cart 25 towards the cover 30 and comprises a free end.

The cover 30 is mounted to the shuttle 20 to secure the supplying reel 60 and the spooling reel 70. The cover 30 comprises a spiral slot 32, a longitudinal plate 34, a driving hole 35 and a stopping base 38. Preferably, a retaining means may be formed at a rear end of the cover 30 to receive the aforementioned cap 19.

The spiral slot 32 is coaxial to an axis of the probe 10 and receives the guiding protrusion 127 of the driving shaft 12 so that when the probing face of the pin 11 of the probe 10 is pressed against an end face of an optical fiber, the driving shaft 12 retracts backwards while rotating such that the guiding protrusion 127 moves along the spiral slot 32, which allows the cleaning medium on the probing face of the pin 11 to rub against the end face of the optical fiber and remove impurities therefrom. Preferably, the spiral slot 32 is formed through a semi-columnar support 31 supporting the diametrically enlarged portion 126 of the driving shaft 12.

The longitudinal plate 34 is consecutively connected to the semi-columnar support 31 with a leveled junction 33 so as to cover the rear cart 25 of the shuttle 20. Preferably, the longitudinal plate 34 comprises an anti-bending means such that as demonstrated by the current embodiment has a pair of side blocks 341 and a pair of plate-end stabilizers 342. The side blocks 341 are respectively positioned at a center portion of longitudinal sides of the top surface of the longitudinal plate 34. The plate-end stabilizers 342 are formed at a junction of the top surface of the longitudinal plate 34 and the leveled junction 33. The side blocks 341 and the stabilizers 342 prevent the longitudinal plate 34 from bending during the operation process of the polisher.

The longitudinal plate 34 may further comprise a protrusion 39 formed on a bottom surface of the longitudinal plate 34 and selectively contacting the free end of the elastic piece 29. When the shuttle 20 moves relative to the cover 30, the protrusion 39 temporarily deforms the elastic piece 29. The elastic piece 29 restores its original shape after being released from the contact with the protrusion 39, and produces a ticking sound which informs the user the extend of the relative travel of the shuttle 20 relative to the cover 30. A bending longitudinal plate 34 might increase the distance of the protrusion 39 and the free end of the elastic piece 29 that the protrusion 39 fails to contact the free end of the elastic piece 29. As aforementioned, the side blocks 341 and the stabilizers 342 prevent unwanted bending of the longitudinal plate 34 and as a result ensure the selective contact of the protrusion 39 to the free end of the elastic piece 29.

The driving hole 35 is formed on the longitudinal plate 34 and receives the driving protrusion 82 of the driving disc 80. The stopping base 38 engages the shuttle 20 and the resilient actuator 40 is mounted between the stopping base 38 and the shuttle 20. Preferably, the resilient actuator 40 is mounted between the stopping base 38 and a positioning protrusion 28 of the shuttle 20.

When the driving shaft 12 retracts and pushes the shuttle 20 backward, the backward-moving shuttle 20 pushes the resilient actuator 40 against the base 38, during which the spooling reel 70 and the driving disc 80 are moving backward with the shuttle 20 while the driving protrusion 82 is held by the driving hole 35 of the cover 30, which forces the spooling reel 70 to rotate and to pull out a clean medium held between the axle 63 and the inner surfaces of the holding plates 62, 64 of the supplying reel 60.

When the probing face of the pin 11 is no longer pressed, the resilient actuator 40 pushes the shuttle 20 and the probe 10 forward to perform a next cleaning process.

The casing 90 receives and secures the probe 10, the shuttle 20, the cover 30 and the resilient actuator 40 and comprises a first end, a front opening 91, a rear opening 92, an optional window 95 and an optional hooking hole 96. The front opening 91 is formed on the first end and allows the probe 10 to protrude out from the first end of the casing 90. As demonstrated in the current embodiment, the casing 90 secures the probe 10, the shuttle 20, the cover 30 and the resilient actuator 40 at the relative positions, which may be inserted inside the casing 90 through the rear opening 92 which is opposite to the front opening 91, so that with the help of the actuator 40, the probe 10 and the shuttle 20 may move to and fro relatively to the cover 30 within the casing 90.

The window 95 is defined through the casing 90 and allows the user to observe the parts received within the casing 90, especially the remaining quantity of the cleaning medium held by the supplying reel 60. The function of the window 95 may be further improved when most or all the parts of the probe 10, the shuttle 20, the cover 30 and the resilient actuator 40 are made of transparent material.

The hooking hole 96 may be used to connect the polisher to a belonging of the user with a retaining means to provide convenience for portability. The hooking hole 96 may also be used to tie a retaining cord that connects the hooking hole 96 and a ring 195 attached to the cap 19 so as to secure the cap 19 while the cap 19 is removed from the first end 151 of the cushion column 15.

The casing 90 may further comprise an adjusting means, which may be a pen clip 50 connecting the cover 30, to adjust the pushing strength of the resilient actuator 40, especially when the flexibility of the resilient actuator 40 reduces owing to long-time or repetitive uses. As demonstrated in the current embodiment, the casing 90 comprises a pen clip 50 as an adjusting means to adjust the position of the cover 30 from outside of the casing 90.

The pen clip 50 is firmly mounted to a connecting base 36 of the cover 30 through a longitudinally sectioned hole 93 formed on a portion of the casing 90 corresponding to the cover 30, wherein the connecting base 36 is preferably formed on a top surface of the longitudinal plate 34 of the cover 30. Preferably, the pen clip 50 comprises a connector 51 detachably mounted to the connecting base 36. The pen clip 50 may slide within the sectioned hole 93 and be fastened at a section of the sectioned hole 93 to hold an assembly of the probe 10, the shuttle 20 and the cover 30 at a position corresponding to the section. More preferably, the pen clip 50 may be single-handedly operated by pushing the pen clip 50 against the casing 90 to slide and release the pen clip 50 at a section of the sectioned hole 93 to fasten the pen clip 50 in said section.

In order to access a optical fiber end face located deeply within a equipment that requires a probe of larger length, the pen clip 50 may be moved toward the first end of the casing 90 and fastened to a section of the sectioned hole 93 closer to the first end of the casing 90 to hold the assembly of the probe 10, the shuttle 20 and the cover 30 near the first end of the casing 90, which allows the probe 10 to further protrude from the front opening 91 of the casing 90 for cleaning the optical fiber end face. On the contrary, the pen clip 50 may be moved within the sectioned hole 93 away from the first end of the casing 90 and fastened to a section of the sectioned hole 93 farther from the first end of the casing 90 to draw back the probe 10 from the front opening 91 of the casing 90 to provide a compact size of the polisher in accordance with the present invention.

In order to increase portability and convenience, as demonstrated in the current embodiment, the casing 90 may further comprise a magnet seat 94 for installing a magnet or magnetic device to temporarily attach the portable optical fiber end face polisher in accordance with the present invention to a nearby white board or a chassis. Preferably, the magnet seat 94 is formed on an opposite surface to the pen clip 50.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A portable optical fiber end face polisher comprising
- a probe comprising
  - a driving shaft comprising
    - a first end;
    - a second end opposite to the first end; and
    - a guiding protrusion radially protruding from the driving shaft; and
  - a pin mounted to the driving shaft and comprising
    - a point portion protruding from the first end of the driving shaft and comprising
      - a probing face; and
    - two through holes defined through the point portion, each forming an opening on the probing face;
- a shuttle mounted to the second end of the driving shaft and comprising
  - a supplying reel and a spooling reel rotatably mounted to the shuttle in parallel and each comprising
    - an axle comprising
      - a side surface and two ends;
    - two holding plates radially extending respectively from the axle and each comprising
      - an inner surface attached to one end of the ends of the axle and
      - an outer surface, and
    - two toothed-wheels respectively coaxial to the axles of the supplying reel and the spooling reel and respectively attached to the outer surfaces of the holding plates and each comprising
      - a series of circumferentially formed unidirectional teeth, wherein the two toothed-wheels are of identical shape, teeth number and teeth orientation;
  - a driving disc comprising
    - a detent face engaging a toothed-wheel of the spooling reel;
    - a driving face opposite to the detent face; and
    - a driving protrusion eccentrically protruding from the driving face;
- a cover mounted to the shuttle, securing the supplying reel and the spooling reel and comprising
  - a spiral slot coaxial to an axis of the probe and receiving the guiding protrusion of the driving shaft;
  - a driving hole receiving the driving protrusion of the driving disc; and
  - a stopping base engaging the shuttle; and
- a resilient actuator mounted between the stopping base and the shuttle.

2. The portable optical fiber end face polisher as claimed in claim 1, wherein
- the driving shaft further comprises
  - a diametrically enlarged portion at the second end of the driving shaft; and
- the guiding protrusion of the driving shaft protrudes from a side surface of the diametrically enlarged portion;

the probe further comprises
a cushion column receiving the pin and comprising
a first end;
a first end opening selectively exposing the probing face of the pin, and
a resilient pin-cushion mounted in the cushion column and connected to the pin such that the probing portion of the pin selectively protrudes out from the first end opening;
a resilient cushion mounted to a second end of the cushion column;
a base tube comprising
an enlarged cylinder mounted around the diametrically enlarged portion; and
a securing slot formed on a sidewall of the enlarged cylinder and receiving the guiding protrusion;
a receiving cylinder receiving the resilient cushion and selectively receiving the cushion column; and
a securing sleeve securing the cushion column to the base tube.

3. The portable optical fiber end face polisher as claimed in claim 2, wherein
the shuttle comprises
a fore cart receiving the diametrically enlarged portion of the driving shaft and the base tube;
a rear cart tandemly attached to the fore cart and pivotally receiving the supplying reel, the spooling reel and the driving disc and comprising
a bottom;
a first check pawl ratcheting one toothed-wheel of the two toothed-wheels of the supplying reel; and
a second check pawl ratcheting one toothed-wheel of the two toothed-wheels of the spooling reel;
a first shaft formed in the rear cart, pointing toward the cover, pivotally holding the supplying reel through the axle of the supply reel and comprising
a distal end; and
at least one clip formed at the distal end securing the supplying reel to the first shaft; and
a second shaft formed in the rear cart, paralleled with the first shaft, pointing toward the cover, pivotally holding the spooling reel through the axle of the spooling reel and comprising
a distal end; and
at least one clip formed at the distal end securing the spooling reel to the second shaft.

4. The portable optical fiber end face polisher as claimed in claim 3, wherein
the portable optical fiber end face polisher further comprises
a casing receiving and securing the probe, the shuttle, the cover and the resilient actuator and comprising
a first end;
a front opening formed on the first end allowing the probe to protrude out from the first end; and
a rear opening opposite to the front opening.

5. The portable optical fiber end face polisher as claimed in claim 4, wherein
the cover further comprises
a longitudinal plate comprising a top surface; and
a connecting base formed on the top surface;
the casing further comprises
a longitudinally sectioned hole corresponding to the cover; and
a pen clip mounted to the connecting base of the cover through the longitudinally sectioned hole.

6. The portable optical fiber end face polisher as claimed in claim 5, wherein
the casing further comprises
a magnet seat formed on an opposite surface to the pen clip.

7. The portable optical fiber end face polisher as claimed in claim 6, wherein
the rear cart of the shuttle comprises
at least one guiding post defined within the rear cart beside the supplying wheel.

8. The portable optical fiber end face polisher as claimed in claim 7, wherein
a chamfer is formed at an inner rim of each of the ends of the axle of the supplying reel; and
a chamfer is formed at an inner rim of each of the ends of the axle of the supporting reel.

9. The portable optical fiber end face polisher as claimed in claim 8, wherein
the rear cart comprises an elastic piece comprising a free end; and
the longitudinal plate comprises a protrusion formed on a bottom surface of the longitudinal plate and selectively contacting the free end of the elastic piece.

10. The portable optical fiber end face polisher as claimed in claim 9, wherein
the casing comprises a window defined through the casing.

11. The portable optical fiber end face polisher as claimed in claim 10, wherein
the first end of the cushion column comprises a protruding circumferential portion.

12. The portable optical fiber end face polisher as claimed in claim 11, wherein
the polisher comprises a cap comprising
a tubular portion receiving the first end of the cushion column;
a plug formed within the tubular portion and selectively received within the protruding circumferential portion of the first end of the cushion column.

13. The portable optical fiber end face polisher as claimed in claim 12, wherein
the cap comprises
a tip;
a through hole coaxial to the first end opening and formed within the plug and the tip; and
a tip cap connected to the tubular portion with a curl cord.

14. The portable optical fiber end face polisher as claimed in claim 13, wherein
the securing slot is branched and opens at a rear end of the enlarged cylinder.

* * * * *